US006299287B1

(12) United States Patent
Williams et al.

(10) Patent No.: US 6,299,287 B1
(45) Date of Patent: Oct. 9, 2001

(54) PRINTHEAD ARRANGEMENT TO ELIMINATE BI-DIRECTIONAL HUE SHIFTING

(75) Inventors: Kenneth R Williams; Mark S Hickman; Steve O Rasmussen, all of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/479,103

(22) Filed: Jan. 7, 2000

(51) Int. Cl.[7] ..... B41J 2/21
(52) U.S. Cl. ..... 347/43; 347/15; 347/98
(58) Field of Search ..... 347/12, 15, 40, 347/41, 43, 98

(56) References Cited

U.S. PATENT DOCUMENTS

| | | | |
|---|---|---|---|
| 4,833,491 | 5/1989 | Rezanka | 347/43 |
| 5,376,958 | 12/1994 | Richtsmeier et al. | 347/40 |
| 5,742,304 | 4/1998 | Richtsmeier et al. | 347/40 |

FOREIGN PATENT DOCUMENTS

| | | | |
|---|---|---|---|
| 0595658 | 5/1994 | (EP) . | |
| 0955174 | 11/1999 | (EP) . | |
| 1-208143 | 8/1989 | (JP) | B41J/3/04 |
| 2006141 | 1/1990 | (JP) . | |

OTHER PUBLICATIONS

English Translation of JP 63–32614, Feb. 17, 1988, Nakamura.
European Search Report, Apr. 11, 2001, EP 93308687.

*Primary Examiner*—N. Le
*Assistant Examiner*—Lamson D. Nguyen

(57) ABSTRACT

Non-black ink jet printheads are arranged in a printer carriage such that the printhead nozzle arrays are non-overlapping in the carriage swath direction. A fixer printhead is positioned such that the print medium is first advanced past the fixer printhead prior to reaching any of the other printheads. The printheads are selectively driven during each direction of a bi-directional carriage movement, and the print medium is incrementally advanced before each change in carriage movement direction. The order of laying down droplets of different colors is the same during the movement in each direction, thereby eliminating bi-directional hue shifting print artifacts.

24 Claims, 7 Drawing Sheets

PRINTHEAD ARRANGEMENT TO ELIMINATE BI-DIRECTIONAL HUE SHIFTING

TECHNICAL FIELD OF THE INVENTION

This invention relates to ink-jet swath printing devices, and more particularly to techniques for eliminating hue shifting due to bi-directional swath printing.

BACKGROUND OF THE INVENTION

An ink jet printer forms a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

Color ink jet printers commonly employ a plurality of printheads, for example four, mounted in the print carriage to produce different colors. Each printhead contains ink of a different color, with the commonly used colors being cyan, magenta, yellow, and black. These base colors are produced by depositing a drop of the required color onto a dot location. Secondary or shaded colors are formed by depositing drops of different colors on adjacent dot locations; the human eye interprets the color mixing as the secondary or shading, through well known optical principles.

Print quality is one of the most important considerations of competition in the color ink jet printer field. Since the image output of a color ink jet printer is formed of millions of individual ink drops, the quality of the image is ultimately dependent upon the quality of each ink drop and the arrangement of the ink drops on the print medium.

Print head arrangements employed in the past have typically used linear arrays of print elements, wherein the pens of different color are one next to the other. There are several negative consequences of such an arrangement. One is that, when the carriage is going from left to right, the colors are laid down in one order, say YMC for example. When the carriage goes in the other direction, from left to right, the colors are laid down in the opposite order, CMY in this example. The problem with this is that the blue made by first printing cyan and then magenta is slightly different from the blue made in the reverse order. This is because the final dot will inevitably cover a bit of the first dot. This problem is illustrated in FIGS. 1A and 1B. FIG. 1A shows the case of movement left to right, depositing magenta before cyan, so that some cyan overlaps an adjacent magenta dot. FIG. 1B shows the case of movement in the right to left direction, depositing cyan before magenta, so now some magenta overlaps the adjacent cyan dot. Of course, the blue color shifting is only one example; other colors will also suffer from hue shifting in a similar fashion.

A fixer pen can be employed to deposit droplets of a fixer liquid on the print medium at dot locations to subsequently receive droplets of a colored ink. Fixer liquids can be used to cause the subsequently applied colored ink droplets to precipitate very quickly. The fixer liquids can be a cobalt salt, or any other substance by which the colored inks are enhanced. Another problem is that if one wishes to add a fixer ink, which must be printed first, the printer must have two fixer ink pens, one on either side of the colored ink pens, to achieve bi-directional printing. This adds to the expense of the printer. Moreover, the required width of the carriage is increased, due to the need to accommodate two fixer pens. For some printer embodiments, a top coat could also be applied by a top coat pen after applying the colored ink to the print medium, in a post-printing top coat step. An exemplary top coat material is a transparent polymer. Two such top coat pens would be needed for bi-directional printing, further adding to the expense and width of the printer.

Print throughput is degraded with wide carriages due to the increased overtravel. This is illustrated in the diagrammatic illustration of FIG. 2, wherein a printer carriage 10 is mounted for swath movement along a scan axis 12 over a print zone 14 of width A—A. The carriage supports six ink jet pens 16A–16F in a lateral arrangement. FIG. 2 shows the carriage 10 at the leftmost position needed to support printing on the width of the print media, i.e. over the print zone width A—A. The carriage overtravel past the left edge of the print zone is relatively large, due to the pen to pen width and the required acceleration distance needed to accelerate the carriage to achieve the carriage printing speed. Six pens are used here, including two pens 16A, 16F with fixer ink at each end of the carriage. Disposed intermediate the fixer pens are the color pens, e.g. 16B (cyan), 16C (magenta), 16D (yellow) and 16E (black). Two fixer pens are needed in this case to support bi-directional printing. Only the leftmost position of the carriage is shown in FIG. 2; the same carriage overtravel distance must be accommodated on the right side of the print zone.

SUMMARY OF THE INVENTION

In accordance with an aspect of the invention, a technique is described for color inkjet printing to eliminate bi-directional hue shifting. The technique includes:

mounting a printer carriage for bidirectional movement along a print swath axis;

providing a plurality of ink jet printheads of different colors, each printhead having a nozzle array for emitting droplets of ink of non-black color;

supporting the plurality of printheads on the printer carriage such that the respective nozzle arrays do not overlap in a direction along the print swath axis;

moving the printer carriage in a first direction along the swath axis from one side of a print area to a second opposite side of the print area while driving one or more of the printheads to emit droplets under computer control onto a print medium;

providing relative motion between the print medium and the carriage in a direction transverse to the swath axis;advancing the print media;

moving the printer carriage in a second direction along the swath axis from the second side of the print area to the first side while driving one or more of the printheads to emit droplets under computer control onto the print medium;

providing relative motion between the print medium and the carriage in a direction transverse to the swath axis, wherein the order of laying down droplets of different colors is the same during the movement in the second direction as during the movement in the first direction, thereby eliminating bi-directional hue shifting print artifacts.

Another embodiment of the invention is a color inkjet printer, including a printer carriage supported for bi-directional movement along a print swath axis, and a plurality of ink jet printheads of different non-black colors, each printhead having a nozzle array for emitting droplets of ink of non-black color. The plurality of printheads is supported on the printer carriage such that the respective nozzle arrays do not overlap in a direction along the print swath axis. The printer further includes a carriage drive mechanism for moving the printer carriage in a first direction along the swath axis from one side of a print area to a second opposite side of the print area, and in a second direction along the swath axis from the second side of the print area to the first side. A motordriven media advance system provides relative motion between the print medium and the carriage in a direction transverse to the swath axis. A printer controller is coupled to and controls the plurality of printheads, the carriage drive mechanism and the media advance system to achieve bi-directional swath printing on a print medium. The printheads are selectively driven to emit droplets when the carriage is moving in the first direction and when the carriage is moving in the second direction, and to incrementally advance the print medium between carriage swath movements. The order of laying down droplets of different non-black colors is the same during the movement in the second direction as during the movement in the first direction, thereby eliminating bi-directional hue shifting print artifacts.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1A shows the case of movement left to right, depositing magenta before cyan, so that some cyan overlaps an adjacent magenta dot. FIG. 1B shows the case of movement in the right to left direction, depositing cyan before magenta.

DETAILED DESCRIPTION OF THE PREFERRED EMBODIMENTS

Figure 1A:
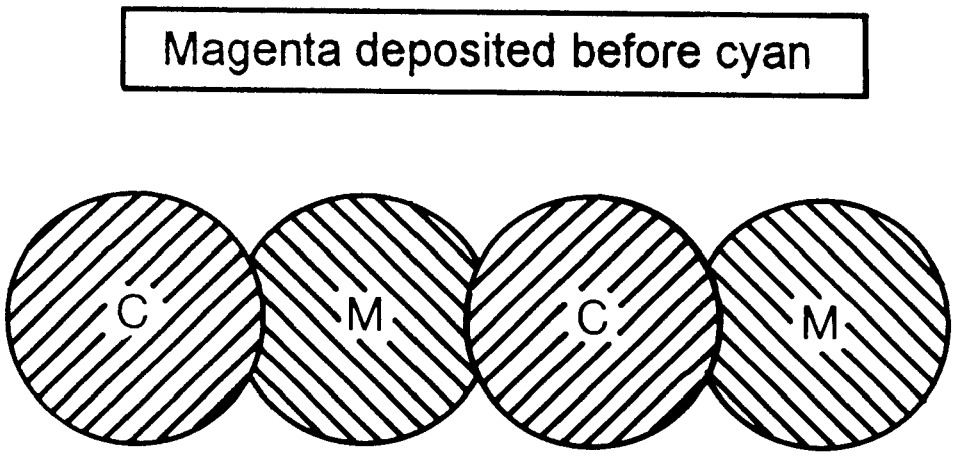
FIGS. 1A and 1B illustrate the problem of hue-shifting due to bi-directional swath printing.
Figure 1B:
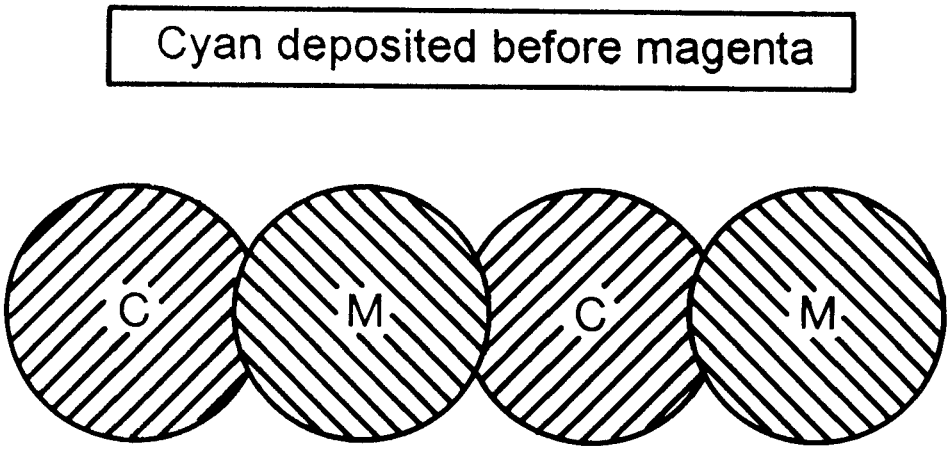
Figure 2:
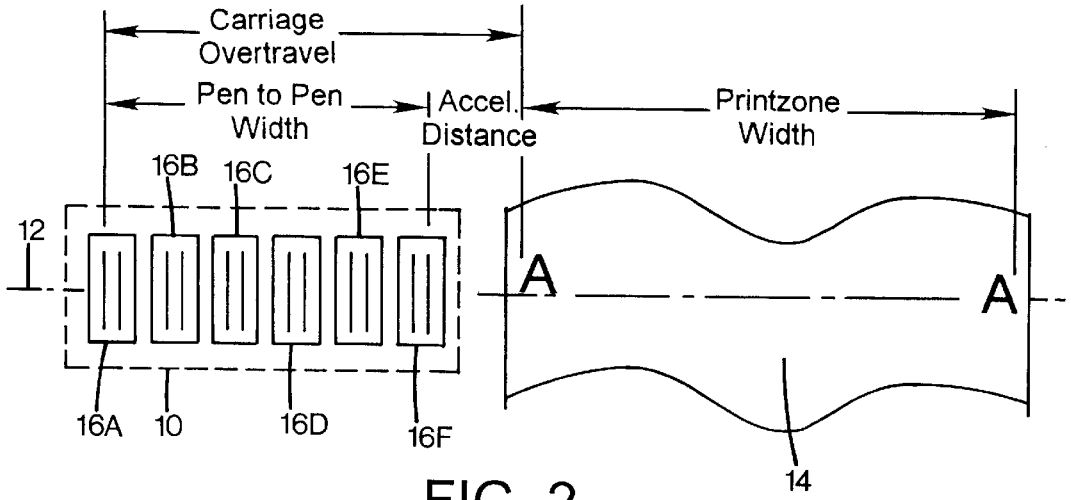
FIG. 2 is a diagrammatic view of a conventional color printhead arrangement, wherein a printer carriage is mounted for swath movement along a scan axis over a print zone.
Figure 3:
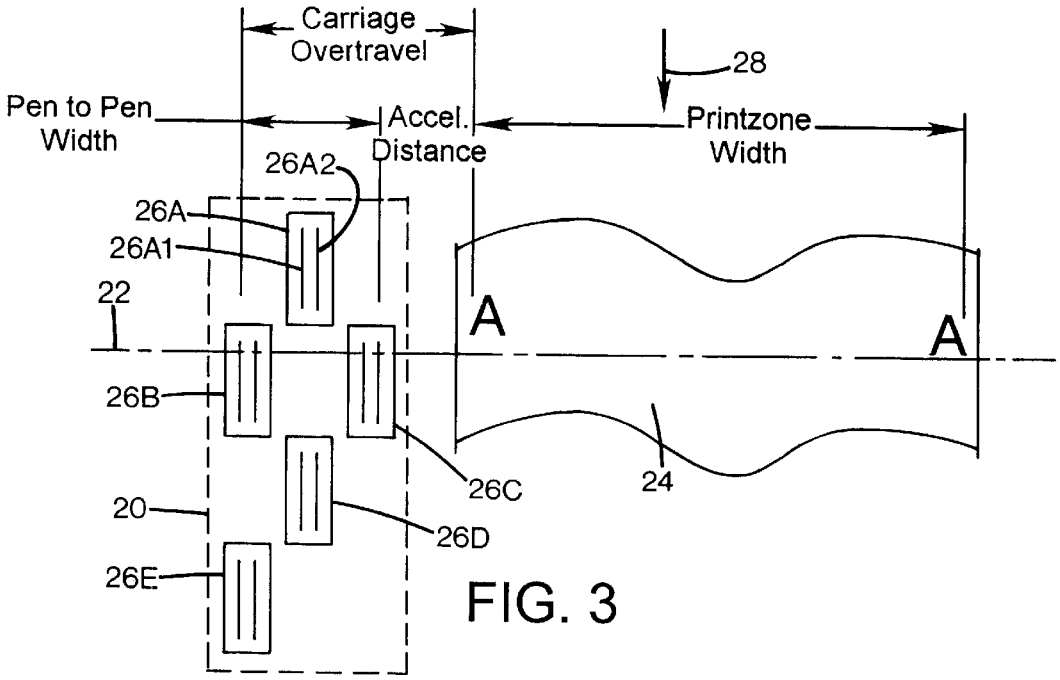
FIG. 3 illustrates a color printhead arrangement embodying an aspect of this invention.

FIG. 3 illustrates a color printhead arrangement embodying an aspect of this invention. In this diagrammatic view, the printer carriage is depicted by dashed box 20. The carriage moves along the swath axis 22 over a print zone 24 of width A—A. The carriage supports the five pens 26A–26E in an arrangement wherein the nozzle arrays of each of the non-black-ink pens do not overlap in the scan direction over the print zone. The nozzle arrays include two columns of nozzles in this embodiment, with each column being represented by two lines for each pen, e.g. nozzle array columns 26A1 and 26A2 for pen 26A. Assume that a media advance direction is depicted by arrow 28. Pen 26A is a fixer pen, emitting droplets of the ink fixer. Pen 26B is a yellow ink pen. Pen 26C is a black ink pen, and overlaps the swath coverage of the yellow pen. The black ink pen would not typically be activated in a print swath for color mixing with a yellow dot, or a magenta or cyan dot, in a typical swath, and is typically used for (monochrome) text printing. Of course, the black ink pen could be used for printing during a color print job, e.g., for shading, borders, text, etc. By positioning the black ink pen immediately adjacent the fixer pen, higher speed printing can be achieved for text (black only) printing. Pen 26D is a cyan ink pen, and pen 26E is a magenta ink pen. This arrangement allows the use of a single fixer pen 26A, instead of requiring a second fixer pen as in the arrangement shown in FIG. 2, since the fixer pen will always encounter a given swath position first, in advance of any of the other pens.

The arrangement of FIG. 3 supports bi-directional swath printing without resulting in undesirable hue-shifting from a swath in a first direction and a swath in the opposite direction. This is because the hue-laying order is the same for each printing direction. This results from the following printing sequence.

As a print medium is advanced along the media path in the printer from an input location to the print zone, arriving at the print zone along direction 28, the leading edge first encounters the fixer pen 26A. A first pass of the carriage on a given print medium in a first direction, say left-to-right, will use only the fixer pen 26A to lay down a pattern of fixer ink dots along the coverage area of its nozzle array. After the first pass, the medium is incrementally advanced by an advance distance. The advance distance will depend on the print mode, and is typically equal to the length of the fixer pen nozzle array, although a smaller distance may sometimes be used to prevent print defects due to such factors as line feed error, misdirected nozzles, weak nozzles and the like. A fresh area of the medium is now positioned below the fixer pen, and the area to which the fixer ink drops was applied is now below the yellow pen 26B and the black pen 26C.

For the second pass of the carriage in the reverse direction, i.e. from right-to-left, the fixer pen 26A and the yellow pen 26B are driven to apply drops of the corresponding liquid. Upon completion of the second pass, the medium is advanced by the same incremental distance, such that a fresh medium area is again below the fixer pen, the second area just traversed by the fixer pen during the second pass is below the yellow pen, and the area to which both fixer and yellow drops have been applied is now below the cyan pen 26D. Now the carriage traverses the print zone on the third pass from left-to-right, with the fixer, yellow and cyan pens driven to apply drops of the corresponding liquid. After completion of the third pass, the medium is again incrementally advanced, and on the fourth pass from right-to-left, all pens are driven to apply droplets of the corresponding liquid.

For the subsequent passes over the body of the medium until the end of the page or print job is approached, all four pens 26A, 26B, 26D, 26E will be driven under computer control to achieve the desired color image, and the order in which drops are applied to a given pen area is the same for both scan directions. Once the bottom of the image is approached, for the last four scans, the operation will be reversed from that described to start the print job.

Figure 4:
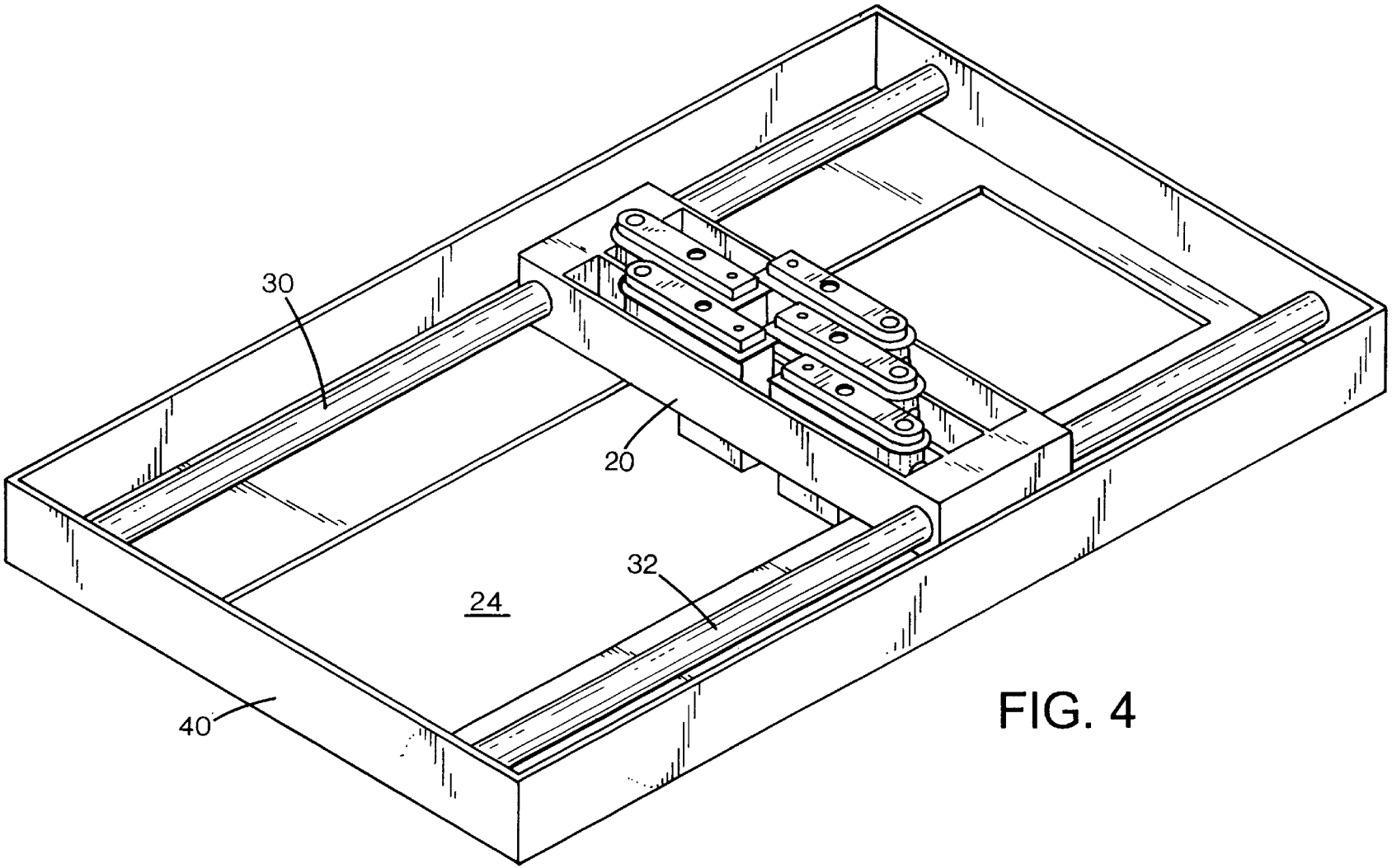
FIG. 4 is a diagrammatic view of a printer carriage and mounting structure for a printer embodying the invention.
Figure 5:
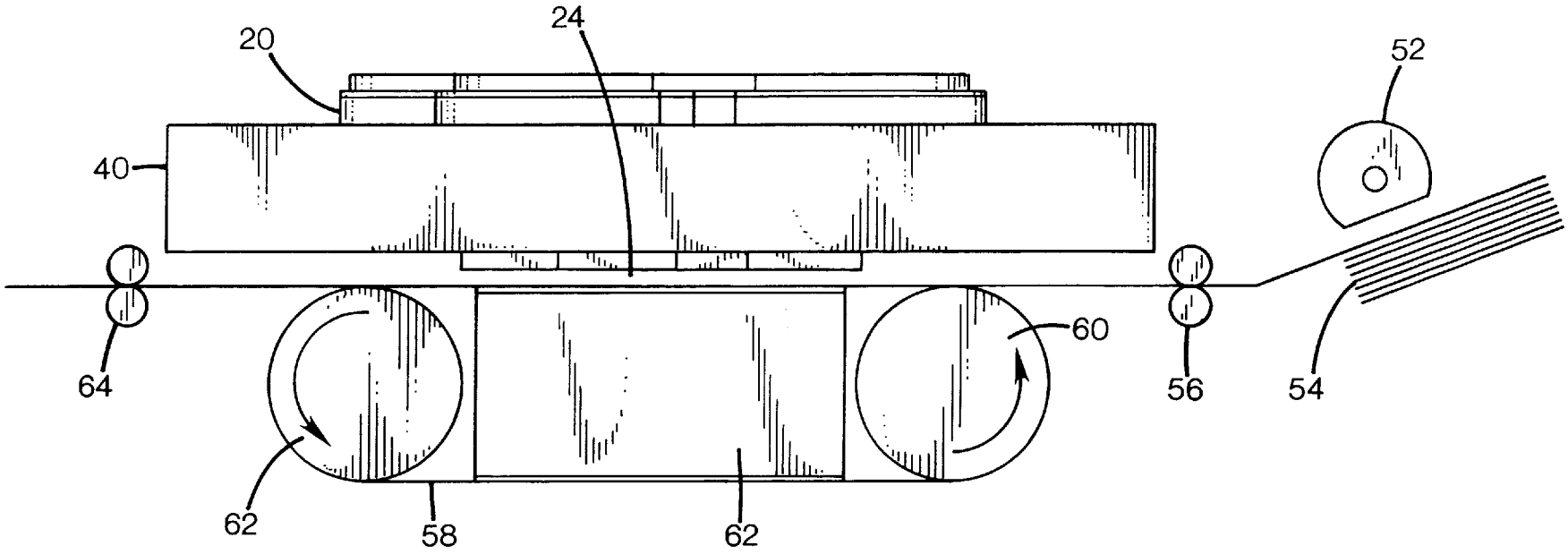
FIG. 5 is a side diagrammatic view illustrating additional aspects of the printer of FIG. 4.
Figure 6:
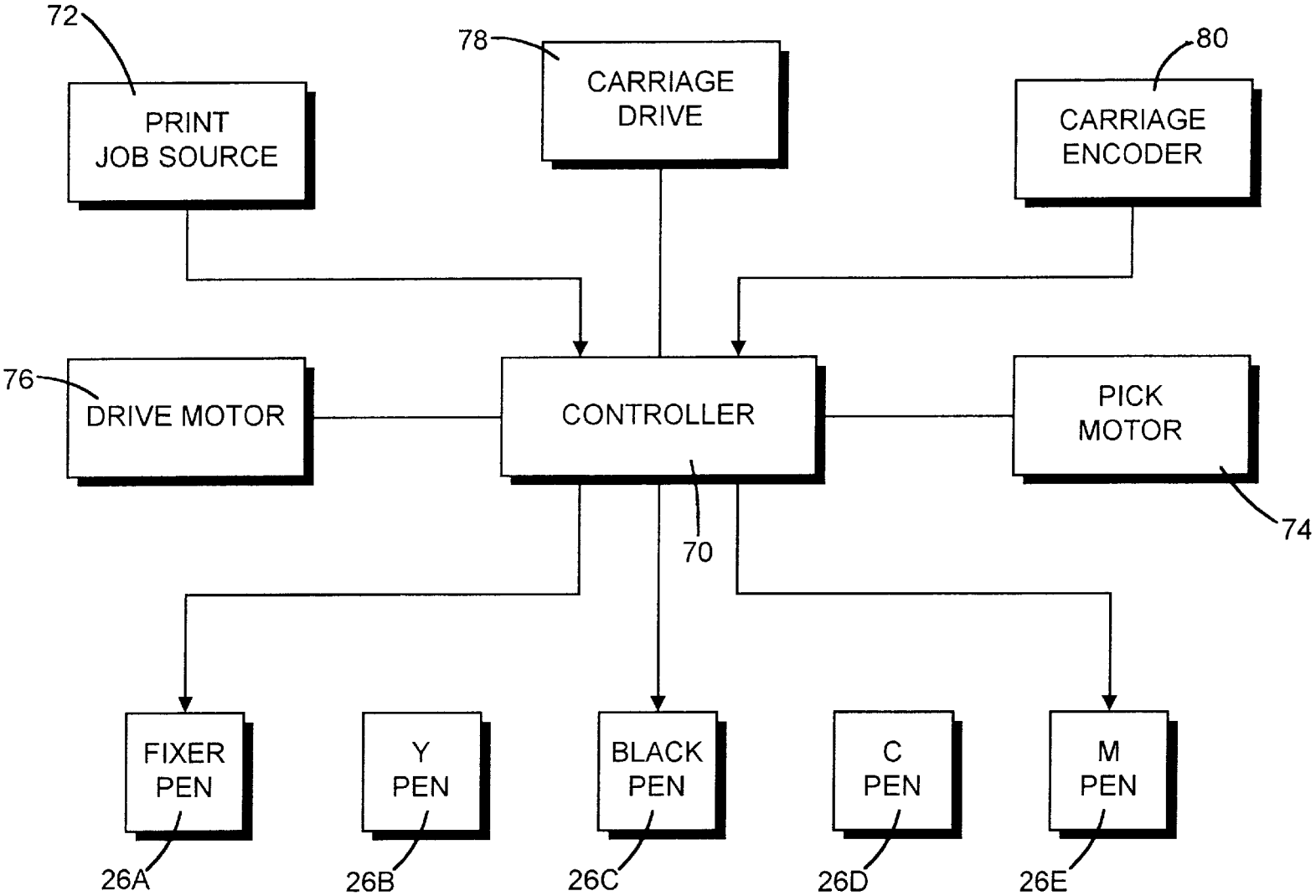
FIG. 6 is a schematic block diagram of aspects of the printer of FIGS. 4 and 5.

FIGS. 4–6 illustrate an exemplary printer system employing the printhead arrangement shown in FIG. 3. The carriage 20 is supported for reciprocating movement over the print zone 24 on guides 30, 32, in turn supported by a frame 40. A carriage drive system (not shown in FIG. 4) is connected to the carriage for accurately positioning and driving the carriage back and forth along the swath axis. Carriage drive systems suitable for the purpose are well known in the art, and can include, for example, an endless belt connected to a motor drive with encoder feedback. The pens 26A–26E are supported in the carriage, and can be replaceable pens such as self-contained cartridges including a printhead with nozzle array and an internal reservoir, or with a tube connecting to an off-carriage reservoir for replenishing an internal ink supply.

One exemplary form of media advance apparatus is illustrated in the simplified diagrammatic side view of FIG. 5. A motor driven pick roller 52 is activated to pick a sheet of the print media from an input source 54, and pass it into the nip between drive roller set 56. The print media may be any type of suitable material, such as paper, card-stock, transparencies, photographic paper, fabric, mylar, metalized media, and the like, but for convenience, the illustrated embodiment is described using paper as the print medium. The invention is also applicable to roll-fed media as well. The sheet is advanced onto an endless perforated belt 58, mounted for rotation on belt pulleys 60, 62. The pulleys are driven to advance the sheet to the print zone 24 under the pens 26A–26E. A vacuum plenum 62 holds the sheet tightly against the belt surface at the print zone. The exiting sheet is passed through the nip formed by output roller set 64 to an output tray (not shown in FIG. 5).

FIG. 6 is a schematic block diagram of the control system for the printer of FIGS. 4–5. A controller 70 such as a microcomputer receives print job commands and data from a print job source 72, which can be a personal computer, digital camera or other known source of print jobs. The controller acts on the received commands to activate the pick roller motor 74 to pick a sheet from the input tray 54, advance the sheet to the nip between the drive roller and pinch roller set 56, and activate the drive motor system 76 to advance the sheet onto the belt, and move the belt to advance the sheet to the print zone. The carriage drive 78 is driven by the controller to position the carriage 20 for commencement of a print job, and to scan the carriage along the slider rods. As this is done firing pulses are sent to the printheads comprising the pens 26A–26E. The controller receives encoder signals from the carriage encoder 80 to provide position data for the carriage. The controller is programmed to advance incrementally the sheet to position the sheet for successive swaths, and to eject the completed sheet into the output tray.

Other printhead arrangements can alternatively be employed in accordance with this invention. For example, a printer employing more than four ink colors can employ a printhead arrangement to eliminate bi-directional hue shifts. Four exemplary additional embodiments are illustrated in FIGS. 7A–7D. In the arrangement of FIG. 7A, eight pens 102A–102H are arranged on a diagonal 104, for ease of construction. In this embodiment pen 102A is a fixer ink pen, pen 102B a black ink pen, pen 102C a yellow ink pen, pen 102D a cyan ink pen, pen 102E a magenta ink pen, pen 102F a red ink pen, pen 102G a green ink pen, and pen 102H a blue ink pen.

Figure 7B:
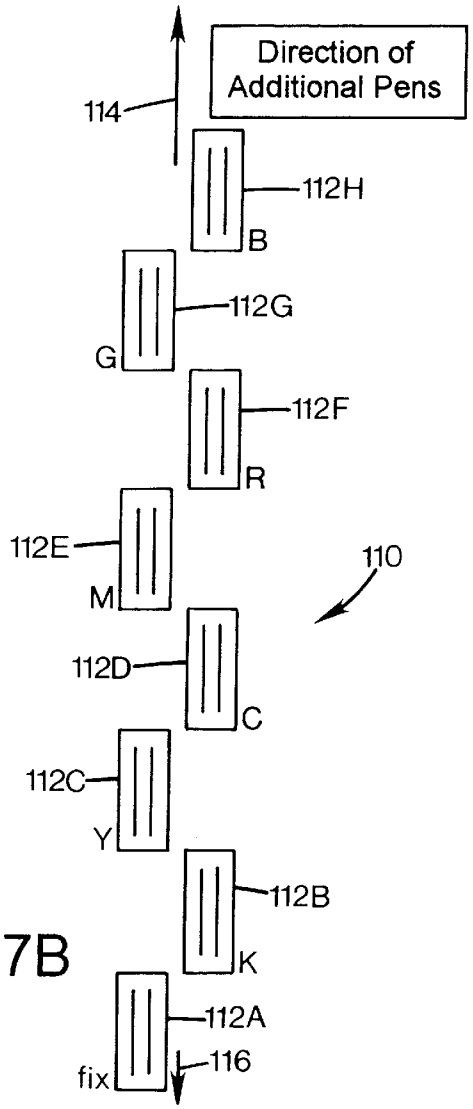
FIGS. 7A–7D illustrate respective alternate configurations of a color printhead arrangement embodying the invention.
Figure 7A:
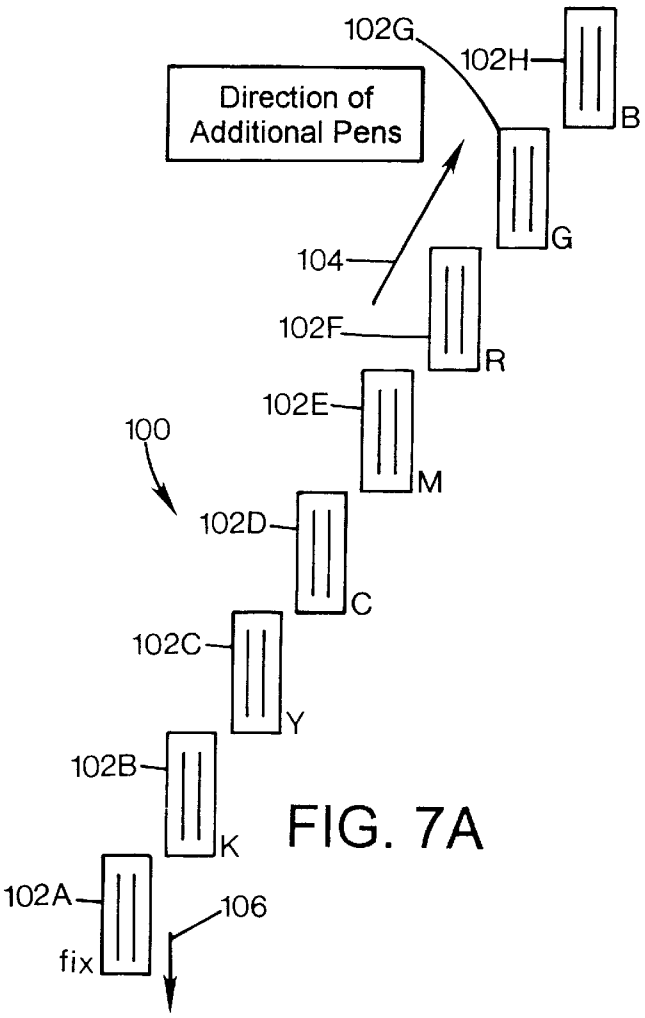

In the arrangement 110 of FIG. 7B, the pens 112A–112H are arranged in a staggered arrangement along an axis 114 parallel to the media advance direction 116, to reduce the width of the carriage in the carriage scan direction, perpendicular to direction 116. In this embodiment, pen 112A is a fixer ink pen, pen 112B a black ink pen, pen 112C a yellow ink pen, pen 112D a cyan ink pen, pen 112E a magenta ink pen, pen 112F a red ink pen, pen 112G a green ink pen, and pen 112H a blue ink pen.

Figure 7D:
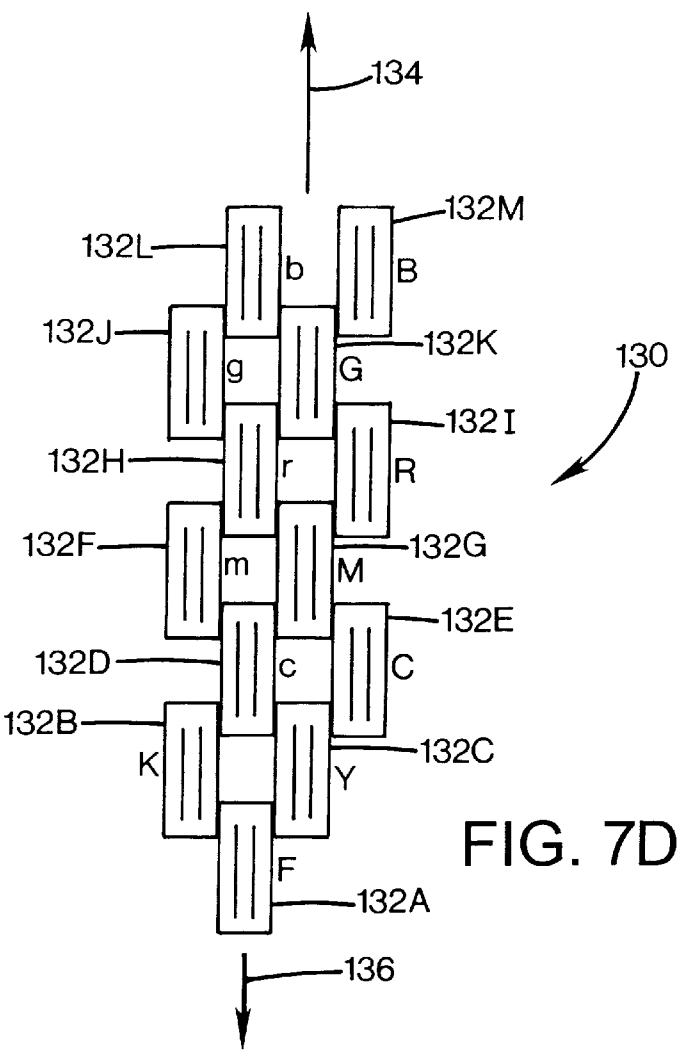
Figure 7C:
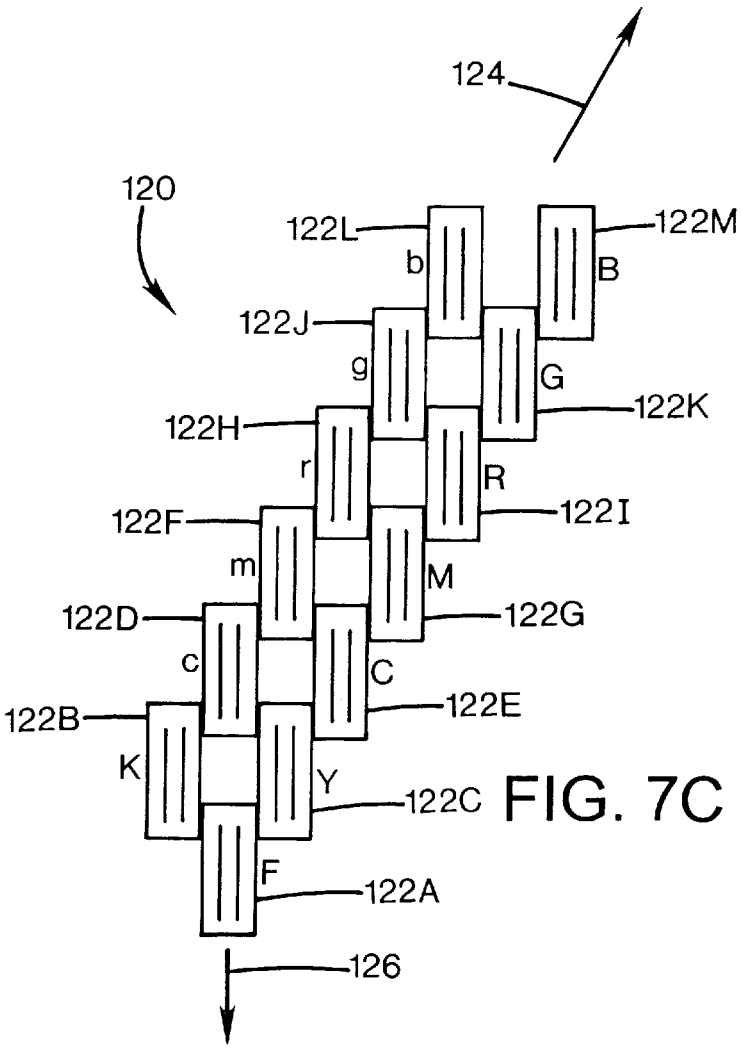

In the arrangement 120 of FIG. 7C, the pens 122A–122M are arranged on a diagonal 124. In this embodiment pen 122A is a fixer ink pen, pen 122B a black ink pen, pen 122C a yellow ink pen, with the nozzle array of the black ink pen overlapping the nozzle array of the yellow ink pen. The remaining pens are in overlapping pairs of light and dark corresponding ink colors. Pen 122D is a light cyan ink pen, and pen 122E is a dark cyan ink pen. Pen 122F is a light magenta ink pen, and pen 122G is a dark magenta ink pen. Pen 122H is a light red ink pen, and pen 122I is a dark red ink pen. Pen 122J is a light green ink pen, and pen 122K is a dark green ink pen. Pen 122L is a light blue ink pen, and pen 122M is a dark blue ink pen.

In the arrangement 130 of FIG. 7D, the pens 132A–122M are arranged on an axis 134 parallel to the media advance direction 136. In this embodiment pen 132A is a fixer ink pen, pen 132B a black ink pen, pen 132C a yellow ink pen, with the nozzle array of the black ink pen overlapping the nozzle array of the yellow ink pen. The remaining pens are in overlapping pairs of light and dark corresponding ink colors. Pen 132D is a light cyan ink pen, and pen 132E is a dark cyan ink pen. Pen 132F is a light magenta ink pen, and pen 132G is a dark magenta ink pen. Pen 132H is a light red ink pen, and pen 132I is a dark red ink pen. Pen 132J is a light green ink pen, and pen 132K is a dark green ink pen. Pen 132L is a light blue ink pen, and pen 132M is a dark blue ink pen.

In each of the arrangements illustrated in FIGS. 7A–7D, colors which may be used for color mixing to achieve a desired secondary color are positioned in non-overlapping positions along the scan axis. Colors which will not be applied in adjacent dot locations for the purpose of color mixing can be arranged in overlapping relationship, and this is illustrated in FIGS. 7C–7D, where black and yellow overlap, as do the respective light and dark colored ink pens.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for bi-directional color inkjet printing, comprising:

providing a printer carriage for bi-directional movement along a print swath axis;

providing a plurality of color ink jet printheads of different colors, each printhead having a nozzle array for emitting droplets of ink of non-black color, and a single fixer ink jet printhead having a nozzle array for emitting droplets of a fixer liquid;

supporting the plurality of color ink jet printheads and the single fixer ink jet printhead on the printer carriage such that the respective nozzle arrays do not overlap in a direction along the print swath axis and the fixer ink jet printhead first encounters a portion of a print medium during printing operations in advance of any of said color ink jet printheads;

moving the printer carriage in a first direction along the swath axis from one side of a print area to a second opposite side of the print area while driving one or more of the printheads to emit droplets under computer control onto a print medium;

providing relative motion between the print medium and the carriage in a direction transverse to the swath axis;

advancing the print media;

moving the printer carriage in a second direction along the swath axis from the second side of the print area to the first side while driving one or more of the printheads to emit droplets under computer control onto the print medium;

providing relative motion between the print medium and the carriage in a direction transverse to the swath axis, wherein an order of laying down droplets of different colors is the same during the movement in the second direction as during the movement in the first direction, thereby eliminating bi-directional hue shifting print artifacts, and wherein the single fixer ink jet printhead is employed during printing operations when moving the printer carriage in said first direction and in said second direction.

2. The method of claim 1 wherein:

said providing relative motion is performed by advancing the print medium in said direction transverse to the swath axis.

3. The method of claim 1 wherein:

providing relative motion between the print medium and the carriage includes incrementally advancing the print medium in relation to the carriage by a distance less than or equal to a nozzle array length of one of the plurality of printheads.

4. The method of claim 1 further comprising:

providing an ink jet printhead having a nozzle array for emitting black ink droplets;

supporting the black ink printhead on the printer carriage; and driving the black ink printhead.

5. The method of claim 4 wherein said supporting the black ink printhead on the printer carriage includes supporting the black ink printhead in alignment with one of said plurality of ink jet printheads such that the nozzle array of said one printhead and the nozzle array of the black ink printhead overlap in a direction along the print swath axis.

6. The method of claim 1, wherein:

said supporting the plurality of printheads on the printer carriage includes supporting the plurality of printheads on a diagonal relative to the direction transverse to the swath axis.

7. The method of claim 6 wherein said supporting the plurality of printheads on a diagonal relative to the direction transverse to the swath axis includes supporting the plurality of printheads in a staggered relationship relative to the diagonal.

8. The method of claim 1, wherein:

said supporting the plurality of printheads on the printer carriage includes supporting the plurality of printheads along the direction transverse to the swath axis.

9. The method of claim 8 wherein said supporting the plurality of printheads along the direction transverse to the swath axis includes supporting the plurality of printheads in a staggered relationship relative to the direction transverse to the swath axis.

10. The method of claim 1, wherein said plurality of color ink jet printheads are employed for color mixing to achieve desired secondary colors, and further comprising:

providing a set of one or more ink jet printheads, each having a nozzle array for emitting ink droplets;

supporting said set of one or more printheads on said carriage such that the nozzle array of each of said one or more printheads overlaps a nozzle array of one of said plurality of color ink jet printheads in a direction along the print swath axis, the overlapping arrays selected to apply color which will not be applied in adjacent dot locations for color mixing.

11. The method of claim 10 wherein said set of one or more printheads includes an ink jet printhead for emitting droplets of black ink.

12. The method of claim 10 wherein said set of one or more printheads includes an ink jet printhead for emitting droplets of a like color of a corresponding overlapped ink jet printhead.

13. A color inkjet printer, comprising:

a printer carriage supported for bi-directional movement along a print swath axis;

a plurality of color ink jet printheads of different non-black colors, each printhead having a nozzle array for emitting droplets of ink of non-black color, and a single fixer ink jet printhead for emitting droplets of a fixer liquid, said plurality of color printheads and said single fixer ink jet printhead supported on the printer carriage such that the respective nozzle arrays do not overlap in a direction along the print swath axis, and wherein the fixer ink jet printhead first encounters a portion of a print medium during printing operations in advance of any of said color ink jet printheads;

bi-directional carriage drive mechanism for moving the printer carriage in a first direction along the swath axis from one side of a print area to a second opposite side of the print area, and in a second direction along the swath axis from the second side of the print area to the first side;

a motor-driven media advance system for providing relative motion between the print medium and the carriage in a direction transverse to the swath axis;

a printer controller coupled to and controlling the plurality of color ink jet printheads and the single fixer ink jet printhead, the carriage drive mechanism and the media advance system to achieve bi-directional swath printing on a print medium, wherein said printheads are selectively driven to emit droplets when the carriage is moving in the first direction and when the carriage is moving in the second direction, and to incrementally advance the print medium between carriage swath movements, wherein an order of laying down droplets of different non-black colors and the fixer liquid is the same during the movement in the second direction as during the movement in the first direction, thereby eliminating bi-directional hue shifting print artifacts while employing a single fixer ink jet printhead.

14. The printer of claim 13 wherein the print medium is advanced in relation to the carriage by a distance less than or equal to a nozzle array length of one of the plurality of printheads between swath movements of the carriage.

15. The printer of claim 13 further comprising:

an ink jet printhead supported on the carriage and having a nozzle array for emitting black ink droplets.

16. The printer of claim 15 wherein the ink jet printhead for emitting black ink droplets is supported on the printer carriage in alignment with one of said plurality of ink jet printheads such that the nozzle array of said one printhead and the nozzle array of the black ink printhead overlap in a direction along the print swath axis.

17. The printer of claim 13 wherein the carriage supports the plurality of printheads on a diagonal relative to the direction transverse to the swath axis.

18. The printer of claim 17 wherein the carriage supports the plurality of printheads in a staggered relationship relative to the diagonal.

19. The printer of claim 13 wherein the carriage supports the plurality of printheads along the direction transverse to the swath axis.

20. The printer of claim 19 wherein the carriage supports the plurality of printheads in a staggered relationship relative to the direction transverse to the swath axis.

21. The printer of claim 13, wherein said plurality of color ink jet printheads are employed for color mixing to achieve desired secondary colors, and further comprising:

a set of one or more ink jet printheads, each having a nozzle array for emitting ink droplets, said set of one or more printheads supported on said carriage such that the nozzle array of each of said one or more printheads overlaps a nozzle array of one of said plurality of color ink jet printheads in a direction along the print swath axis, the overlapping arrays selected to apply color which will not be applied in adjacent dot locations for color mixing.

22. The printer of claim 21 wherein said set of one or more printheads includes an ink jet printhead for emitting droplets of black ink.

23. The printer of claim 21 wherein said set of one or more printheads includes an ink jet printhead for emitting droplets of a like color of a corresponding overlapped ink jet printhead.

24. An inkjet printer, comprising:

a carriage supported for bi-directional movement along a swath axis;

a plurality of color ink jet printheads of different non-black colors, each having a nozzle array for emitting ink droplets of non-black color, and a single fixer ink jet printhead with a nozzle array for emitting fixer liquid droplets, said plurality of color printheads and said single fixer ink jet printhead mounted on the carriage such that the respective nozzle arrays do not overlap in a direction along the swath axis, and wherein the fixer ink jet printhead first encounters a portion of a print medium during printing operations in advance of any of said color ink jet printheads;

bi-directional carriage drive mechanism;

media advance system for providing relative motion between the print medium and the carriage in a direction transverse to the swath axis;

a controller for controlling said printheads, the carriage drive mechanism and the media advance system to achieve bi-directional swath printing and to incrementally advance the print medium between carriage swath movements.

* * * * *